US009039151B2

(12) United States Patent
Shimizu

(10) Patent No.: US 9,039,151 B2
(45) Date of Patent: May 26, 2015

(54) LIQUID EJECTION APPARATUS

(71) Applicant: BROTHER KOGYO KABUSHIKI KAISHA, Nagoya-shi, Aichi-ken (JP)

(72) Inventor: Seiji Shimizu, Ogaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/322,456

(22) Filed: Jul. 2, 2014

(65) Prior Publication Data

US 2015/0091990 A1 Apr. 2, 2015

(30) Foreign Application Priority Data

Sep. 30, 2013 (JP) ..... 2013-203599

(51) Int. Cl.
*B41J 2/175* (2006.01)
*B41J 2/19* (2006.01)

(52) U.S. Cl.
CPC ..... *B41J 2/19* (2013.01); *B41J 2/17556* (2013.01); *B41J 2/17596* (2013.01)

(58) Field of Classification Search
CPC ..... B41J 2/17556; B41J 2/17596; B41J 2/17513; B41J 2/17523; B41J 2/19
See application file for complete search history.

(56) References Cited

U.S. PATENT DOCUMENTS

2008/0297545 A1 12/2008 Umeda
2008/0297579 A1 12/2008 Umeda
2010/0289856 A1 11/2010 Yamamoto et al.
2012/0127242 A1 * 5/2012 Koike et al. ..... 347/85

FOREIGN PATENT DOCUMENTS

JP 2009-006695 A 1/2009
JP 2009-126044 A 6/2009

* cited by examiner

*Primary Examiner* — Juanita D Jackson
(74) *Attorney, Agent, or Firm* — Merchant & Gould PC

(57) ABSTRACT

A liquid ejection apparatus includes: a head including: a reservoir tank; an inlet opening; and ejection openings; an air-discharge passage for discharging air from the reservoir tank to an outside; a first sucking device for sucking air from the reservoir tank via the air-discharge passage; a semipermeable membrane dividing a space in the reservoir tank and the air-discharge passage, into a reservoir-tank-side space and a first-sucking-device-side space and allowing communication of the air and inhibiting communication of liquid between the reservoir-tank-side space and the first-sucking-device-side space; and a first valve mechanism dividing the reservoir-tank-side space into a first space on a semipermeable-membrane side and a second space on an inlet-opening side, inhibiting fluid from flowing from the first space to the second space, and allowing fluid to flow from the second space to the first space. The first space is located above the ejection openings.

8 Claims, 9 Drawing Sheets

LIQUID EJECTION APPARATUS

CROSS REFERENCE TO RELATED APPLICATION

The present application claims priority from Japanese Patent Application No. 2013-203599, which was filed on Sep. 30, 2013, the disclosure of which is herein incorporated by reference in its entirety.

BACKGROUND OF THE INVENTION

1. Field of the Invention

The present invention relates to a liquid ejection apparatus configured to eject liquid onto a recording medium to form an image thereon.

2. Description of the Related Art

There is conventionally known an ink jet recording apparatus including a liquid ejection head configured to eject ink onto a recording medium to record an image thereon. As an internal structure of the liquid ejection head, ink chambers each for storing ink are superposed on each other in an up and down direction, and upper portions of the ink chambers respectively have air-discharge openings for discharging air bubbles from the inside of the ink. Provided in each of the air-discharge opening is a seal member. Each of the air-discharge openings is connected to a pump for placing the corresponding ink chamber under negative pressure. The seal member allows gas to be discharged and inhibits liquid from being discharged.

When air bubbles are discharged from the inside of the ink, the pump is operated to suck air bubbles accumulated in an upper portion of the ink chamber. A liquid level of the ink stored in each ink chamber rises, and accordingly the ink is brought into contact with the seal member. This contact is performed before the liquid level of the ink becomes higher than the air-discharge openings, preventing the ink from moving to a position higher than the air-discharge openings. This construction prevents the ink from being discharged from the air-discharge openings and allows only the air bubbles from being discharged.

In general, the liquid ejection head has an ejection surface which is to face a recording medium and formed with a multiplicity of ejection openings for ejecting ink. Such a liquid ejection head typically carries out a purging operation for maintaining and recovering ink ejection characteristics. This purging operation is an operation for discharging the ink from the ejection openings by applying a pressure to the ink in the ink chambers or by applying a suction pressure to the ink in the ejection openings.

SUMMARY OF THE INVENTION

However, in the case where the ink is discharged from the ejection openings by application of a suction pressure to the ink in the ejection openings, air may be sucked from the air-discharge opening.

In the conventional construction, the air bubbles in the ink can be efficiently discharged from the air-discharge opening. In the purging operation, however, the pressure in the ink chamber is reduced by the suction pressure applied to the ink in the ejection openings, and air may be sucked from the air-discharge opening via the seal member. In this suction of the air, a negative pressure equal to or greater than an allowable pressure of the seal member may be applied to the seal member, leading to damage to the seal member. In the event of the damage to the seal member, not only air bubbles but also ink may be discharged from the air-discharge opening when air bubbles are discharged in the next time.

This invention has been developed to provide a liquid ejection apparatus capable of reducing a possibility of damage to a seal member disposed in an air-discharge opening during a purging operation.

The present invention provides a liquid ejection apparatus including: a liquid ejection head including: a reservoir tank configured to store liquid; an inlet opening which communicates with the reservoir tank; and a plurality of ejection openings which communicate with the reservoir tank; an air-discharge passage, extending from the reservoir tank, for discharging air in a space in the reservoir tank, to an outside; a first sucking device configured to suck air from the reservoir tank via the air-discharge passage; a semipermeable membrane which divides a space constituted by the space in the reservoir tank and the air-discharge passage, into a reservoir-tank-side space and a first-sucking-device-side space, the semipermeable membrane allowing communication of the air between the reservoir-tank-side space and the first-sucking-device-side space, the semipermeable membrane inhibiting communication of the liquid between the reservoir-tank-side space and the first-sucking-device-side space; and a first valve mechanism configured to divide the reservoir-tank-side space into (a) a first space located on a semipermeable-membrane side of the first valve mechanism and (b) a second space located on an inlet-opening side of the first valve mechanism, the first valve mechanism being configured to inhibit fluid from flowing from the first space to the second space, the first valve mechanism being configured to allow fluid to flow from the second space to the first space. The first space is located above the plurality of ejection openings.

The present invention provides a liquid ejection apparatus including: a liquid ejection head including: a reservoir tank configured to store liquid; an inlet opening which communicates with the reservoir tank; and a plurality of ejection openings which communicate with the reservoir tank; an air-discharge passage, extending from the reservoir tank, for discharging air in a space in the reservoir tank, to an outside; a first sucking device configured to suck air from the reservoir tank via the air-discharge passage; a semipermeable membrane which divides a space constituted by the space in the reservoir tank and the air-discharge passage, into a reservoir-tank-side space and a first-sucking-device-side space, the semipermeable membrane allowing communication of the air between the reservoir-tank-side space and the first-sucking-device-side space, the semipermeable membrane inhibiting communication of the liquid between the reservoir-tank-side space and the first-sucking-device-side space; and a check valve configured to divide the reservoir-tank-side space into (a) a first space located on a semipermeable-membrane side of the check valve and (b) a second space located on an inlet-opening side of the check valve, the check valve being configured to allow fluid to flow from the second space to the first space. The first space is located above the plurality of ejection openings.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which:

FIGS. 4A and 4B are views illustrating a structure of the liquid ejection head, wherein FIG. 4A illustrates an initial state, and FIG. 4B illustrates a state during a suction purging operation;

FIGS. 7A and 7B are views illustrating a structure of a liquid ejection head in a second embodiment, wherein FIG. 7A illustrates an initial state, and FIG. 7B illustrates an air-discharge purging state;

DETAILED DESCRIPTION OF THE EMBODIMENTS

Figure 1:
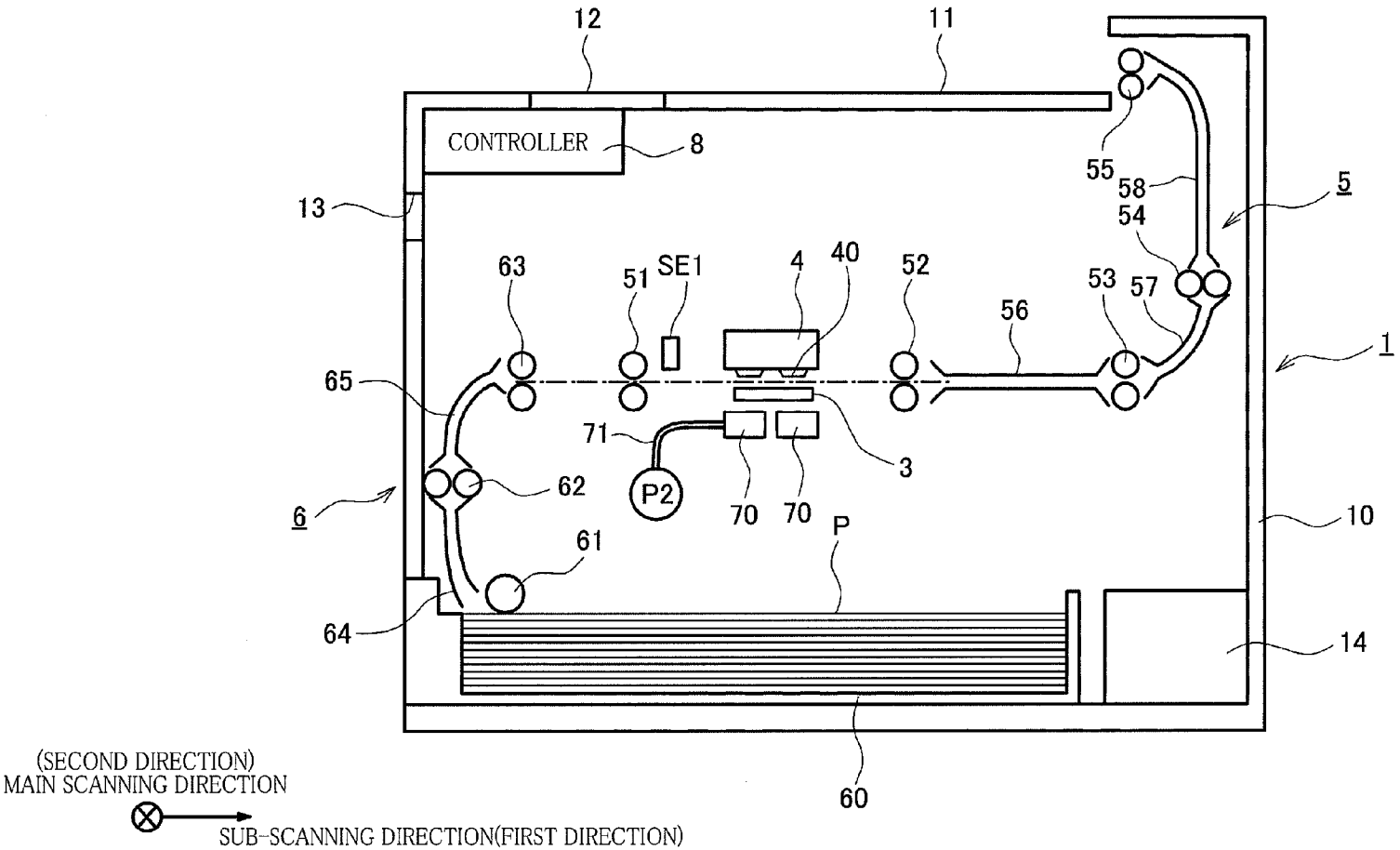
FIG. 1 is a front elevational view illustrating an internal structure of an ink jet recording apparatus.

Hereinafter, there will be described embodiments of the present invention by reference to the drawings. The up and down direction in the following explanation is along the vertical direction. An ink jet recording apparatus will be explained by way of example as a liquid ejection apparatus according to the present invention, and this ink-jet recording apparatus is configured to eject liquid or ink onto a recording medium in the form of a sheet to record an image thereon. Also, one example of gas in the present invention is air in the following embodiment.

An ink jet recording apparatus 1 includes a housing 10 having a rectangular parallelepiped shape. A tray 11 is provided on a top plate of the housing 10 to receive a sheet P to be discharged. The housing 10 contains: a liquid ejection head 4 configured to eject ink onto the sheet P in the down direction; a conveyor unit 5 configured to convey the sheet P in the horizontal direction in FIG. 1 to convey the sheet P to the tray 11; and a sheet-supply unit 6 configured to supply the sheet P to the conveyor unit 5. Provided under the liquid ejection head 4 is a platen 3 which is opposed to the liquid ejection head 4 to support the sheet P within a horizontal plane in FIG. 1.

A controller 8 is disposed in an upper portion of the interior of the housing 10 so as not to interfere with the liquid ejection head 4. This controller 8 controls devices and electric circuits provided in the housing 10. Disposed in a lower portion of the interior of the housing 10 is a tank 14 which stores ink to be supplied to the liquid ejection head 4. The tank 14 and the liquid ejection head 4 are connected by a tube, not shown, and the ink stored in the tank 14 is supplied to the liquid ejection head 4. The liquid ejection head 4 is provided above the tank 14, so that a negative pressure corresponding to a hydraulic head pressure acts on the ink in the liquid ejection head 4.

A terminal 13 is provided on a side face of the housing 10, and this terminal 13 receives a signal transmitted from an external personal computer and containing an image recording job. The signal received by the terminal 13 is transmitted to the controller 8. An operation panel 12 is provided on an upper face of the housing 10, and a user operates this operation panel 12 to input information.

The conveyor unit 5 is a mechanism configured to convey the sheet P in the right direction and in the up direction to the tray 11 in FIG. 1. In the following description, a direction in which the sheet P is conveyed just under the liquid ejection head 4 will be referred to as "sub-scanning direction" or "first direction" ("sheet conveying direction"). A direction perpendicular to the sheet conveying direction and within a plane in which the sheet P is conveyed in the first direction will be referred to as "main scanning direction" or "second direction". In FIG. 1, the first direction is a direction directed horizontally from the left side to the right side, and the second direction is a direction perpendicular to a sheet surface of the sheet P.

The conveyor unit 5 includes: first and second conveyor roller pairs 51, 52 arranged on opposite sides of the liquid ejection head 4; third, fourth, and fifth conveyor roller pairs 53, 54, 55 disposed on downstream of the second conveyor roller pair 52 in the sheet conveying direction; and three guides 56, 57, 58 for guiding the sheet P conveyed therein. A leading portion sensor SE1 for sensing a leading edge portion of the sheet P conveyed is provided between the first conveyor roller pair 51 and the liquid ejection head 4. A detection signal output by the leading portion sensor SE1 is transmitted to the controller 8. When the leading edge portion of the sheet P is detected by the leading portion sensor SE1, the liquid ejection head 4 starts ejecting the ink onto the sheet P upon a lapse of a predetermine length of time from the detection. The liquid ejection head 4 ejects the ink onto the sheet P conveyed by the first conveyor roller pair 51 in the horizontal plane.

The sheet P conveyed through the position just under the liquid ejection head 4 is then conveyed by the second conveyor roller pair 52 disposed downstream of the liquid ejection head 4 in the sheet conveying direction. The sheet P is thereafter conveyed to the tray 11 by the conveyor roller pairs 53, 54, 55 and the guides 56, 57, 58 arranged between the second conveyor roller pair 52 and the tray 11.

The sheet-supply unit 6 includes: a sheet-supply tray 60 for storing a plurality of sheets P; a sheet-supply roller 61; conveyor roller pairs 62, 63 disposed between the sheet-supply roller 61 and the conveyor unit 5; and two guides 64, 65 for guiding the sheet P conveyed therein. The sheet-supply roller 61 supplies the sheets P from the sheet-supply tray 60 at regular intervals, and the guides 64, 65 and the conveyor roller pairs 62, 63 convey each supplied sheet P to a position located upstream of the conveyor unit 5 in the sheet conveying direction.

The liquid ejection head 4 is a line head having a rectangular parallelepiped shape elongated in the main scanning direction (i.e., the second direction). A lower face of the liquid ejection head 4 has a plurality of ejection faces 40 each formed with a multiplicity of ejection openings 42 or nozzles from which the ink is to be ejected.

The sheet P printed by the liquid ejection head 4 is discharged onto the tray 11 by the conveyor roller pairs 52, 53, 54, 55 and the guides 56, 57, 58.

Under the platen 3, a plurality of liquid receivers 70 arranged horizontally are provided movably upward and downward with respect to the platen 3. Each of the liquid receivers 70 is shaped like a cap. During the ink ejection onto the sheet P for image recording, each liquid receiver 70 is located under the conveyance path for the sheet P so as not to interfere with the image recording. The liquid receivers 70 receive the ink ejected or discharged from the liquid ejection head 4 in a state in which the sheet P is not conveyed on the platen 3. It is noted that waste liquid tubes 71 are connected to bottom faces of the respective liquid receivers 70 and also connected to a liquid suction pump P2. The liquid suction pump P2 sucks the ink ejected or discharged to the liquid receivers 70.

The liquid ejection head 4 includes a plurality of head elements 41 provided on the lower face of the liquid ejection head 4. In the state in which the sheet P is not conveyed on the platen 3, the liquid ejection head 4 is moved downward, and the head elements 41 respectively pass through holes, not shown, formed through the platen 3 and are fitted on the respective liquid receivers 70. In this state, a purging operation is performed to maintain or recover ink ejection characteristics of the liquid ejection head 4. The purging operation is an operation for discharging the ink from the ejection openings 42. Examples of the purging operation include: a discharge of ink due to pressure increase or reduction; and a discharge of ink due to liquid ejection caused by an ink ejecting operation. In the present embodiment, a suction purging operation is performed as the purging operation by way of example in which the ink is forcibly sucked from the ejection faces 40 by the pump in a state in which the ejection faces 40 are covered with the respective liquid receivers 70.

Figure 2:
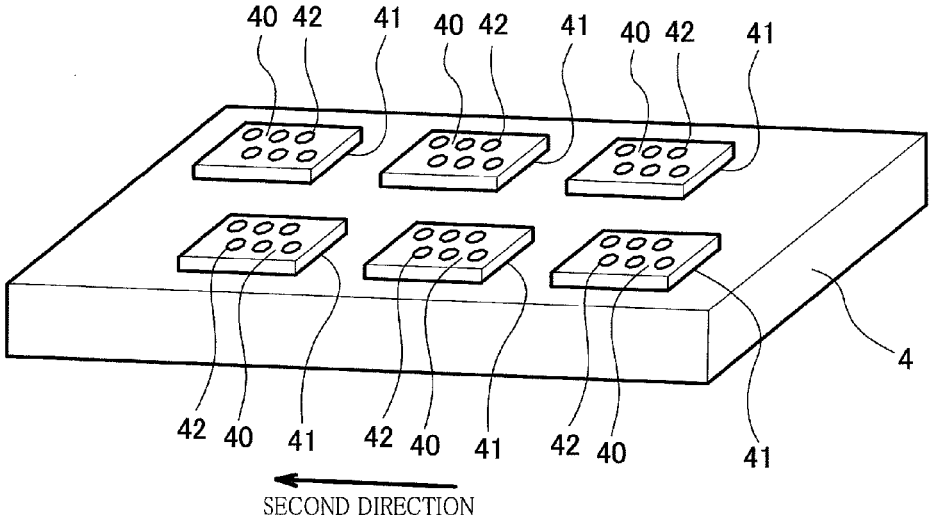
FIG. 2 is a perspective view illustrating a liquid ejection head when viewed from a lower side thereof.

As illustrated in FIG. 2, the head elements 41 project from the lower face of the liquid ejection head 4 and are arranged in a staggered configuration along the second direction. The above-described ejection faces 40 are lower faces of the respective head elements 41, and the ejection openings 42 are formed in the ejection faces 40. The head elements 41 have the same construction in order to uniform the ink ejection characteristics and reduce manufacturing cost, for example. While the six head elements 41 are arranged in the staggered configuration along the second direction in this liquid ejection head 4, the number of the head elements 41 is not limited to six.

Each of the head elements 41 is constituted by: a passage unit including a plurality of metal plates stacked on one another; and actuator units bonded to an upper surface of the passage unit. The actuator units are energized to eject the ink from the passage unit. A lower face of a lowermost one of the metal plates of the passage unit constitutes the ejection face 40, and the actuator units are connected to the controller 8. These structures are well known, and a detailed explanation is dispensed with.

Figure 3:
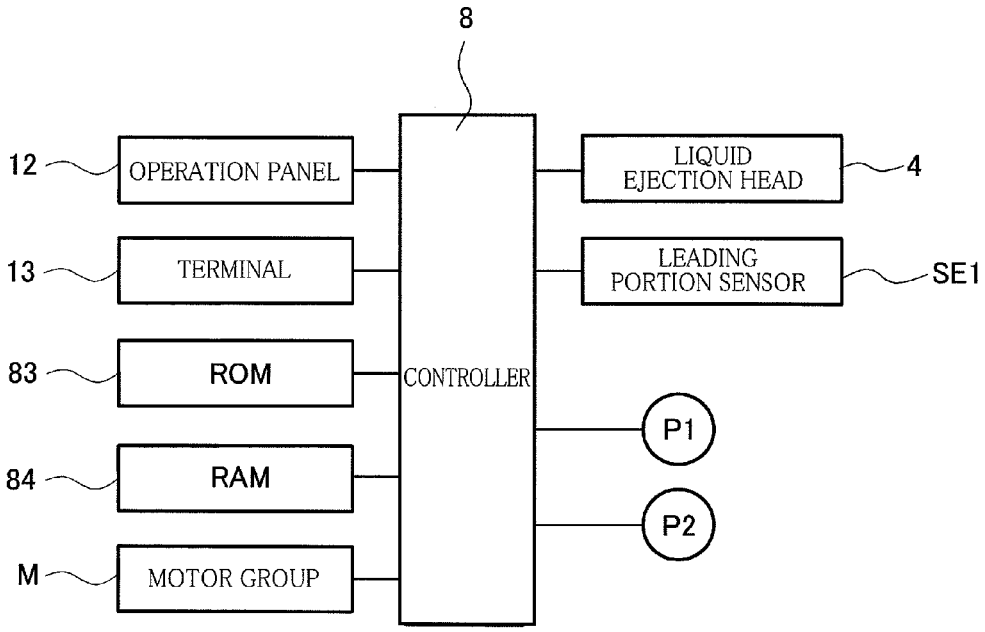
FIG. 3 is a block diagram illustrating a controller and devices connected thereto.

There will be next explained the controller 8 and devices connected thereto with reference to FIG. 3. The controller 8 includes one or more CPUs. The controller 8 may be constituted by one or more CPUs and one or more application specific integrated circuits (ASIC) in combination.

Devices connected to the controller 8 include: the operation panel 12; the terminal 13; a motor group M for rotating the conveyor roller pairs 51-55, 62, 63; a ROM 83 storing programs for operating various devices; a RAM 84 serving as a working memory for temporarily storing information; the liquid ejection head 4; and the leading portion sensor SE1. The devices connected to the controller 8 further include: the liquid suction pump P2 connected to the liquid receivers 70; and an air suction pump P1, which will be described below, for sucking air from the liquid ejection head 4, and the controller 8 controls the pumps P1, P2.

First Embodiment

Figure 4A:
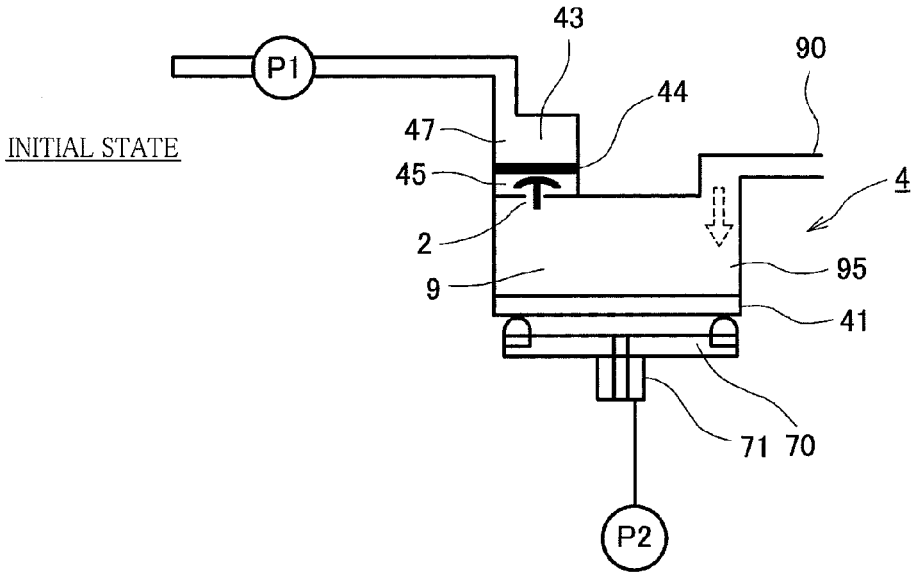
Figure 4B:
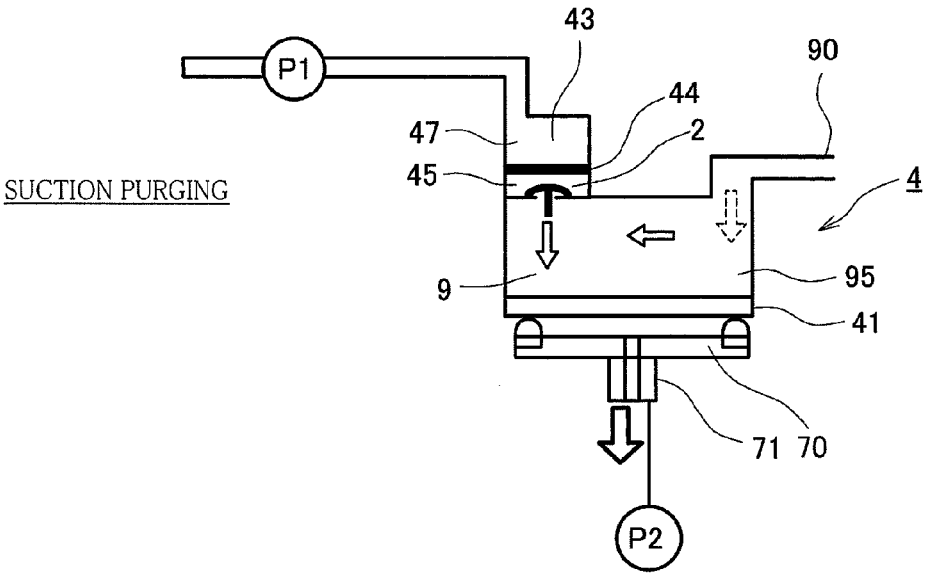

FIG. 4A illustrates an initial state of the liquid ejection head 4, and FIG. 4B illustrates a state of the liquid ejection head 4 during the suction purging operation. The platen 3 is not illustrated in FIGS. 4A and 4B for easier understanding.

The liquid ejection head 4 includes: the head elements 41; a reservoir tank 9, provided on an upper side of the head elements 41, for storing the ink supplied from the tank 14; and an inlet opening 90 through which the ink supplied from the tank 14 flows into the reservoir tank 9. Air accumulated in the reservoir tank 9 is discharged via an air-discharge passage 43. In the air-discharge passage 43, a semipermeable membrane 44 is provided for allowing air to pass therethrough and inhibiting the ink from passing therethrough. The semipermeable membrane 44 partitions the air-discharge passage 43 into a space 47 located on an air-suction-pump side of the semipermeable membrane 44 and a space located on a reservoir-tank side of the semipermeable membrane 44 (noted that this space is an air accumulating chamber 45 as one example of a first space which will be described below). Also, a space constituted by an inner space of the reservoir tank 9 and the space of the air-discharge passage 43 which is located on the reservoir-tank side of the semipermeable membrane 44 (i.e., the air accumulating chamber 45) is partitioned by a check valve 2 into the first space (i.e., the air accumulating chamber 45) which is located on a semipermeable-membrane side of the check valve 2 and a second space (i.e., a space 95 in the reservoir tank 9 which will be described below) which is located on an inlet-opening side of the check valve 2.

The air suction pump P1 and the air-discharge passage 43 are one example of a first sucking device, and the liquid suction pump P2 and the liquid receivers 70 are one example of a second sucking device.

As illustrated in FIG. 2, the six head elements 41 are disposed on the lower face of the liquid ejection head 4 so as to be arranged in the second direction, but only one head element 41 is illustrated in FIGS. 4A and 4B for easier understanding. In the present embodiment, the first space is the air accumulating chamber 45, and the second space is the space 95 which is a space constituted by (i) the space located nearer to the reservoir tank 9 than the semipermeable membrane 44 and (ii) the space constituted by the inner space of the reservoir tank 9, except the air accumulating chamber 45. The check valve 2 inhibits air from passing from the first space to the second space when the ink is sucked from the reservoir tank 9 by the liquid suction pump P2, and the check valve 2 allows air to pass from the second space to the first space when air is sucked from the air-discharge passage 43 at least by the air suction pump P1. In other words, the check valve 2 inhibits air from flowing from the air accumulating chamber 45 to the reservoir tank 9 in operation of the liquid suction pump P2 and allows the ink to flow from the reservoir tank 9 to the air accumulating chamber 45 at least in operation of the air suction pump P1. The air accumulating chamber 45 is located above the head elements 41 and a liquid level of the ink in the reservoir tank 9, and air bubbles generated in the ink move upward and enter into the air accumulating chamber 45.

The air-discharge passage 43 is connected to the air suction pump P1, and the air suction pump P1 sucks air from the air-discharge passage 43 and the air accumulating chamber 45 to the outside through the air-discharge passage 43.

Air-Discharge Purging Operation

Figure 6:
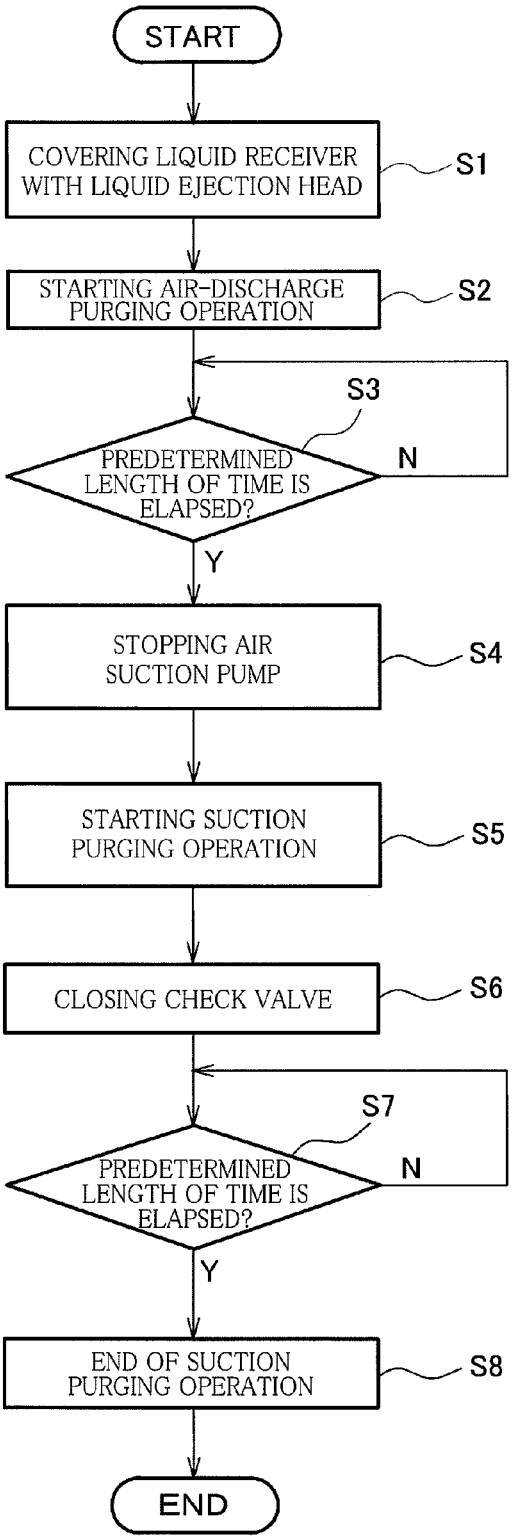
FIG. 6 is a flow chart illustrating processings in the suction purging operation.

In the suction purging operation, the controller 8 executes processings illustrated in FIG. 6.

Figure 5:
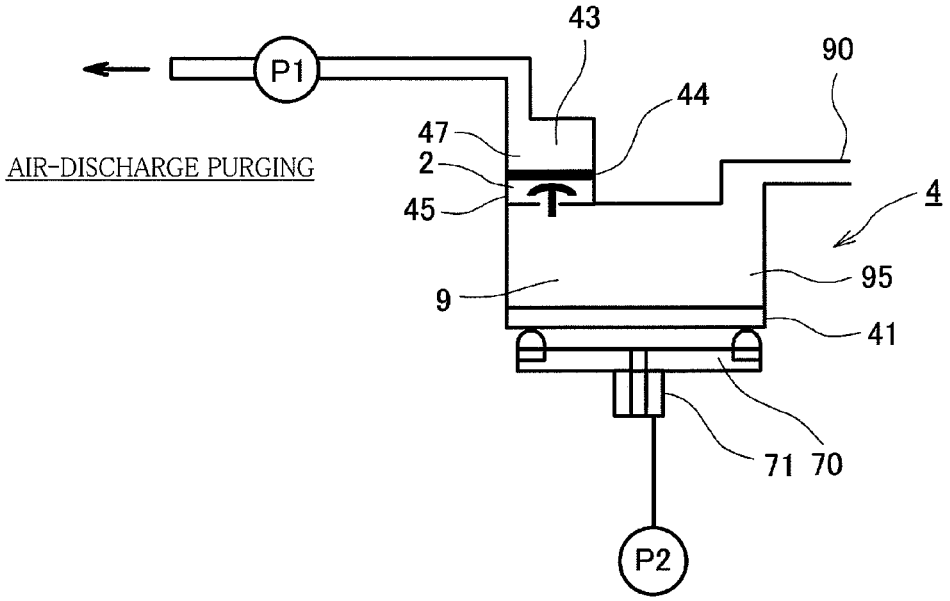
FIG. 5 is a view illustrating a state of the liquid ejection head during an air-discharge purging operation.

The check valve 2 is open before the suction purging operation, i.e., in an initial state in which a difference between an air pressure in the air-discharge passage 43 and an air pressure in the air accumulating chamber 45 is zero or near zero. This flow begins with S1 at which the liquid ejection head 4 is moved downward to cover the liquid receivers 70. As illustrated in FIG. 5, the air suction pump P1 is at S2 actuated to suck the air from the air accumulating chamber 45. This operation will be referred to as "air-discharge purging operation". Since the air in the air accumulating chamber 45 is sucked in the state in which the check valve 2 is open, the ink in the reservoir tank 9 is sucked into the air accumulating chamber 45. The ejection faces 40 are covered with the liquid receivers 70 in this operation, preventing air from flowing from the ejection openings 42 into the reservoir tank 9. The semipermeable membrane 44 also prevents the ink from flowing from the semipermeable membrane 44 into the air-discharge passage 43 located near the air suction pump P1 than the reservoir tank 9.

The pressure (i.e., the air pressure) in the air-discharge passage 43 is about −3 kPa before the start of the air-discharge purging operation and is about −10 kPa during the air-discharge purging operation. The pressure in the air accumulating chamber 45 is about −3 kPa before the start of the air-discharge purging operation but is assumed to be about −5 kPa during the air-discharge purging operation. The pressure in the air-discharge passage 43 is about −10 kPa during the air-discharge purging operation as described above, but the pressure in the air-discharge passage 43 suffers a pressure loss due to the resistance of the semipermeable membrane 44. This pressure loss is assumed to be about 5 kPa, and accordingly the pressure in the air accumulating chamber 45 is assumed to be about −5 kPa during the air-discharge purging operation (−10 kPa+5 kPa=−5 kPa).

After a predetermined length of time is elapsed from the start of the air-discharge purging operation (S3), the controller 8 at S4 stops the operation of the air suction pump P1. Each of the pressure in the air-discharge passage 43 and the pressure in the air accumulating chamber 45 is about −3 kPa after the stop of the air suction pump P1.

Suction Purging Operation

After the stop of the air-discharge purging operation, the controller 8 at S5 controls the liquid suction pump P2 to perform the suction purging operation in which the liquid suction pump P2 sucks the liquid from the reservoir tank 9 toward the liquid receivers 70. Here, the reason why the air-discharge purging operation is performed before the suction purging operation will be explained. If air remains in the air accumulating chamber 45 during the suction purging operation, the liquid suction pump P2 may take in the air from the air accumulating chamber 45 to the ejection openings 42 when sucking the ink from the reservoir tank 9. This leads to an ink ejection failure when the ink is ejected from the ejection openings 42 to record an image on the sheet P after the suction purging operation. In order to prevent this problem, the air-discharge purging operation is performed before the suction purging operation to remove the air from the air accumulating chamber 45.

Before the start of the suction purging operation, each of the pressure in the air-discharge passage 43 and the pressure in the air accumulating chamber 45 is about −3 kPa as described above. The pressure in the reservoir tank 9 is also about −3 kPa. This pressure in the reservoir tank 9 corresponds to a hydraulic head pressure of the tank 14.

In the suction purging operation, the ink in the air accumulating chamber 45 is sucked with the suction of the ink by the liquid suction pump P2. When air in the air-discharge passage 43 is about to be sucked by the sucking operation, the check valve 2 is closed at S6 as illustrated in FIG. 4B. A working pressure of the check valve 2 is about 2 kPa, and each of the pressure in the air-discharge passage 43 and the pressure in the air accumulating chamber 45 is about −5 kPa as a result of pressure reduction by about 2 kPa from the pressure established before the start of the suction purging operation. Also, the suction pressure of the liquid suction pump P2 is assumed to be about −50 kPa to sufficiently eject or discharge the ink. Accordingly, the pressure in the reservoir tank 9 is reduced to about −50 kPa. In the suction purging operation, since the check valve 2 is closed, the air is not sucked from the air-discharge passage 43, so that the pressure for sucking the air from the air-discharge passage 43 does not act on the semipermeable membrane 44. This prevents damage to the semipermeable membrane 44.

When a predetermined length of time is elapsed from the start of the suction purging operation (S7), the suction purging operation is finished at S8. As illustrated in FIG. 4A, the check valve 2 returns to its open state. That is, the state in which the difference between the pressure in the air-discharge passage 43 and the pressure in the air accumulating chamber 45 is zero or near zero is reestablished. It is noted that the internal pressure values of the air-discharge passage 43, the air accumulating chamber 45, and the reservoir tank 9 are not limited to the above-described values.

Second Embodiment

There will be next explained a liquid ejection head 4 according to a second embodiment with reference to FIGS. 7A-9. This liquid ejection head 4 is provided with a subsidiary check valve 20 disposed in the space 47 located nearer to the air suction pump P1 than the semipermeable membrane 44 in the air-discharge passage 43. That is, the subsidiary check valve 20 partitions the space 47 near the air suction pump P1 in the air-discharge passage 43 into (i) a downstream chamber 46 (as one example of a third space) which is a space located nearer to the semipermeable membrane 44 than the subsidiary check valve 20 and (ii) a space 48 (as one example of a fourth space) located nearer to the air suction pump P1 than the subsidiary check valve 20. The subsidiary check valve 20 allows air to flow in a direction in which the air suction pump P1 sucks the air (i.e., in a direction directed from the downstream chamber 46 toward the space 48) and inhibits air from flowing in a direction reverse to the sucking direction. In other words, the subsidiary check valve 20 allows air to flow from the downstream chamber 46 to the space 48 in operation of the air suction pump P1 and inhibits air from flowing from the space 48 to the downstream chamber 46 in operation of the liquid suction pump P2. It is noted that the downstream chamber 46 is defined between the subsidiary check valve 20 and the check valve 2 in the air-discharge passage 43.

Figure 7A:
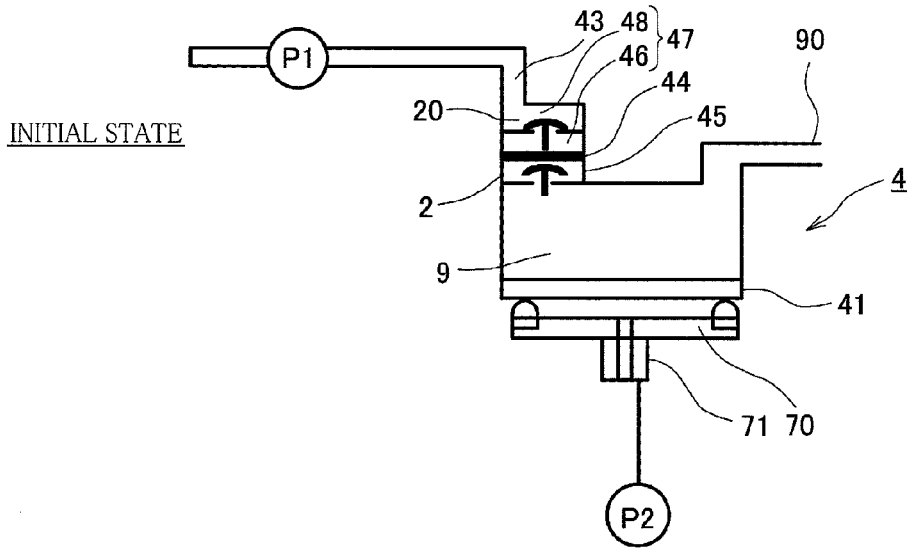
Figure 7B:
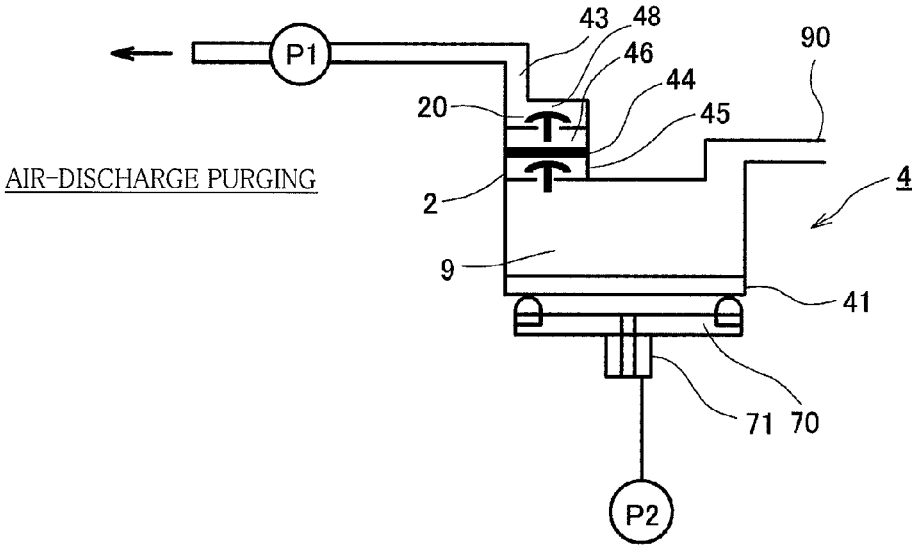

In the initial state illustrated in FIG. 7A, the subsidiary check valve 20 is closed and actuated by a force which is generally the same force required for actuating the check valve 2, for example, the subsidiary check valve 20 is actuated by a force of about 2 kPa. It is noted that the check valve 2 is open in the initial state as described above. In the initial state, the pressure in each of the reservoir tank 9, the air accumulating chamber 45, the downstream chamber 46, and the air-discharge passage 43 is about −3 kPa.

In a case where the air-discharge passage 43 is long, changes in, e.g., a temperature around the air-discharge passage 43 may change the pressure of the air in the air-discharge passage 43, causing the check valve 2 to be closed unintentionally. Also, a load due to the change of the pressure of the air in the air-discharge passage 43 may act on the semipermeable membrane 44. In the present embodiment, these problems are solved by the subsidiary check valve 20 provided downstream of the semipermeable membrane 44 in the direction in which air is sucked.

Air-Discharge Purging Operation

As described above, as illustrated in FIG. 7B, the air-discharge purging operation is performed using the air suction pump P1 in advance of the suction purging operation. When the pressure of discharged air exceeds a working pressure of the subsidiary check valve 20, the subsidiary check valve 20 is opened, so that the ink flows into the air accumulating chamber 45. The semipermeable membrane 44 prevents the ink from flowing from the semipermeable membrane 44 toward the air suction pump P1. The working pressure of the subsidiary check valve 20 is about 2 kPa. Thus, each of the pressure in the air accumulating chamber 45 and the pressure in the reservoir tank 9 is about −5 kPa obtained by reducing about 2 kPa from the pressure established in the initial state.

The pressure in the air-discharge passage 43 is about −10 kPa during the air-discharge purging operation as described above, and accordingly the pressure in the downstream chamber 46 is also about −10 kPa. There is a difference of about 5 kPa between the pressure in the air accumulating chamber 45 and the pressure in the downstream chamber 46, but the pressure loss due to the semipermeable membrane 44 is about −5 kPa. Therefore, the pressure on an upstream side of the semipermeable membrane 44 and the pressure on a downstream side of the semipermeable membrane 44 in the direction in which the air suction pump P1 sucks the air are in equilibrium.

Figure 8A:
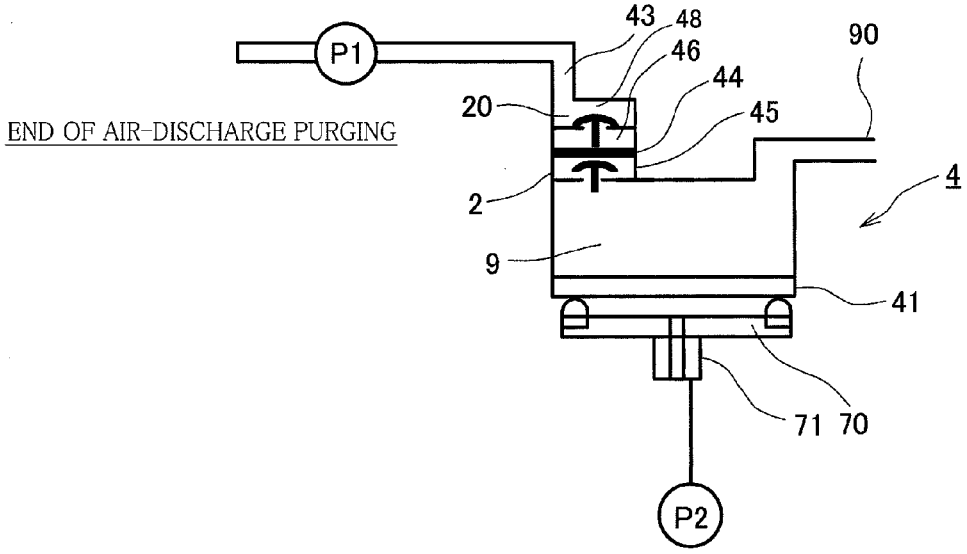
FIG. 8A is a view illustrating a state of the liquid ejection head after a completion of an air-discharge purging operation.

When the predetermined length of time is elapsed from the start of the air-discharge purging operation, the controller 8 stops the operation of the air suction pump P1. As illustrated in FIG. 8A, the subsidiary check valve 20 is closed. At the end of the air-discharge purging operation, the pressure in the air-discharge passage 43 is returned to about −3 kPa from −10 kPa. Just after the subsidiary check valve 20 is closed, the pressure in the air accumulating chamber 45 is about −5 kPa obtained by reducing the working pressure of the subsidiary check valve 20 from the pressure in the air-discharge passage 43, and the pressure in the downstream chamber 46 is about −10 kPa obtained by reducing the pressure loss due to the semipermeable membrane 44. Since the check valve 2 is open, the pressure in the air accumulating chamber 45 becomes a negative pressure, so that the air accumulating chamber 45 is filled with the ink. The pressure in the downstream chamber 46 is thereafter returned to about −3 kPa, and each of the air accumulating chamber 45, the reservoir tank 9, and the pressure in the air-discharge passage 43 also becomes about −3 kPa.

Suction Purging Operation

Figure 8B:
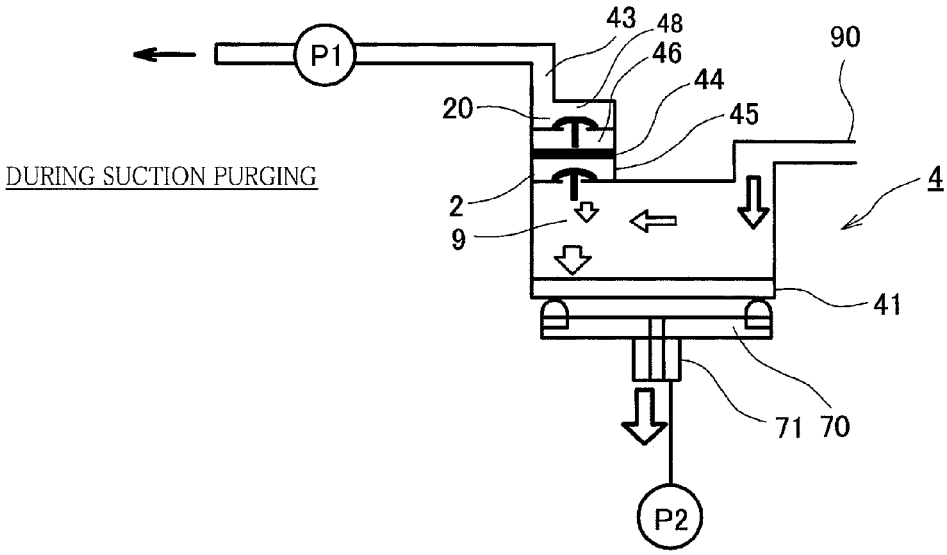
FIG. 8B is a view illustrating a state of the liquid ejection head during a suction purging operation.

After the end of the air-discharge purging operation, the suction purging operation is performed. FIG. 8B illustrates a state during the suction purging operation. The liquid suction pump P2 sucks the ink from the reservoir tank 9 and accordingly sucks the ink from the air accumulating chamber 45. The check valve 2 is closed when the suction pressure exceeds the working pressure of the check valve 2. As a result, a space in the reservoir tank 9 which is located downstream of the check valve 2 in the ink sucking direction is enclosed. The pressure in the reservoir tank 9 becomes about −50 kPa, and each of the pressure in the air accumulating chamber 45 and the pressure in the downstream chamber 46 becomes about −5 kPa because the check valve 2 is closed in a state in which the working pressure of the check valve 2 is reduced from each pressure at the start of the suction purging operation. Since the check valve 2 is closed, the pressure in the air-discharge passage 43 is kept at about −3 kPa.

Figure 9:
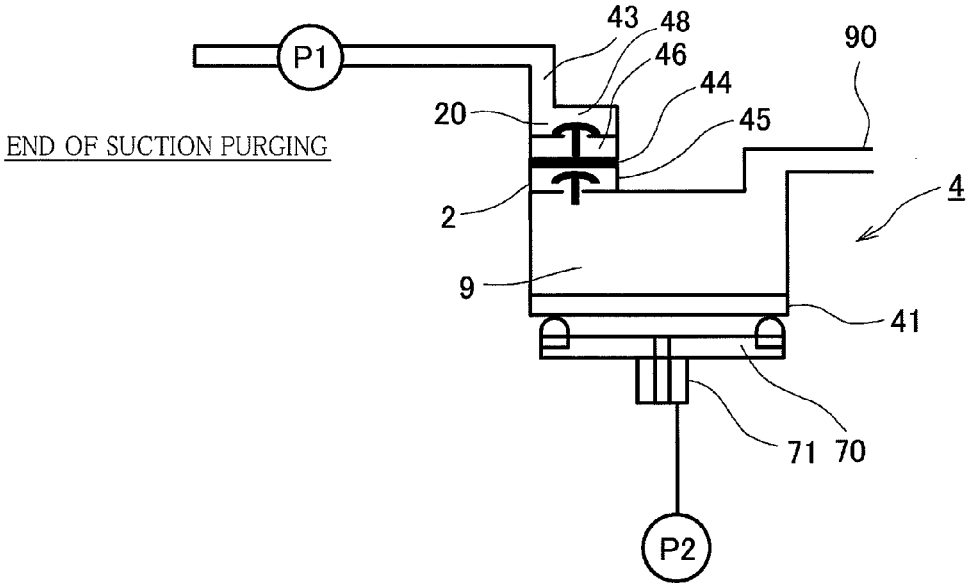
FIG. 9 is a view illustrating a state of the liquid ejection head at a completion of the suction purging operation.

The suction purging operation is stopped when a predetermined length of time is elapsed from the start of the suction purging operation. The pressure in the reservoir tank 9 is gradually returned from about −50 kPa to about −3 kPa as the hydraulic head pressure. Since the pressure in the air accumulating chamber 45 is about −5 kPa, the check valve 2 is opened as illustrated in FIG. 9, so that the ink flows into the air accumulating chamber 45. As a result, the pressure in the air accumulating chamber 45 becomes closer to about −3 kPa as the hydraulic head pressure. Each of the pressure in the downstream chamber 46 and the pressure in the air-discharge passage 43 also becomes about −3 kPa. As a result, the check valve 2 is opened as illustrated in FIG. 7A, establishing the initial state again in which the subsidiary check valve 20 is closed.

That is, the liquid ejection head 4 provided with the subsidiary check valve 20 can prevent unintentional closing of the check valve 2 or a load imposed on the semipermeable membrane 44 due to, e.g., changes in temperature or air pressure around the air-discharge passage 43. Furthermore, the check valve 2 can be appropriately opened and closed in response to the air-discharge purging operation and the suction purging operation.

Figure 10:
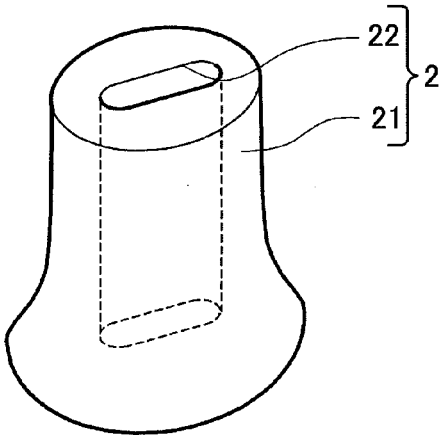
FIG. 10 is a perspective view illustrating a duckbill check valve.

As described above, the check valve 2 is open in the initial state and closed in the suction purging operation. One example of the check valve 2 of this type is a duckbill check valve 2 illustrated in FIG. 10. This duckbill check valve 2 includes a valve body 21 extending in the up and down direction and gradually spreading in its outer shape from its upper end portion toward its lower end portion. The duckbill check valve 2 has an opening 22 formed through a central portion thereof in the up and down direction. The valve body 21 is formed of an elastic material such as synthetic resin, especially, a material noncorrosive to the ink. The valve body 21 is disposed such that the upper end portion points to the semipermeable membrane 44, and the lower end portion points to the head elements 41. In the suction purging operation, the valve body 21 is elastically deformed so as to close the opening 22.

The duckbill check valve is a general purpose component having a well-known construction, leading to reduction in cost. If the valve body 21 is formed of metal, the check valve 2 may adversely affect the ink when soaked in the ink in the air-discharge purging operation. Accordingly, the check valve 2 is formed of the material noncorrosive to the ink.

Figure 11:
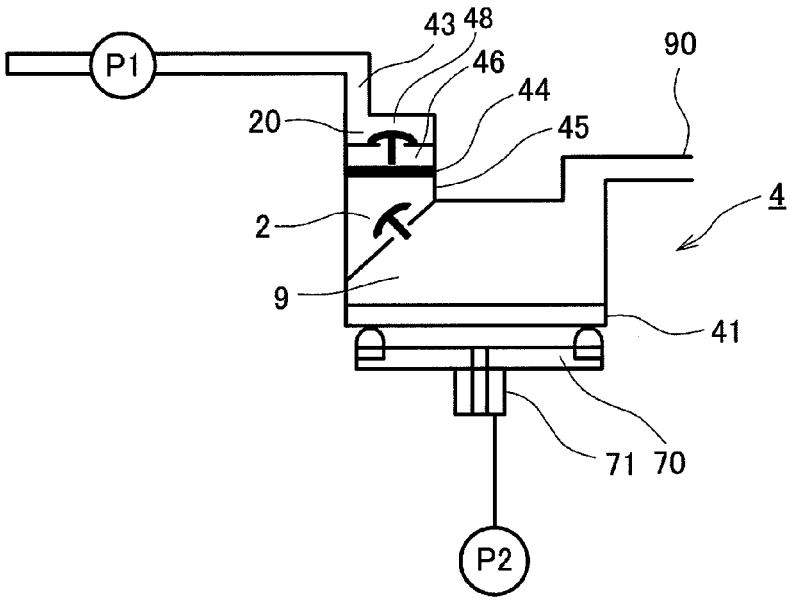
FIG. 11 is a view illustrating a liquid ejection head as a modification.

In the above-described embodiments, the check valve 2 is provided near a horizontal liquid level of the ink in the reservoir tank 9. However, as illustrated in FIG. 11, the check valve 2 may be provided at a position on an obliquely lower side of the horizontal liquid surface of the ink in the reservoir tank 9. That is, the check valve 2 may be provided at any position as long as the check valve 2 is provided at a position defining a space constituted by the space located nearer to the reservoir tank 9 than the semipermeable membrane 44 and the space constituted by the inner space of the reservoir tank 9, into the first space near the semipermeable membrane 44 and the second space near the inlet opening 90 and the head elements 41.

While the semipermeable membrane 44 is disposed in the air-discharge passage 43 in the above-described embodiments, the semipermeable membrane 44 may be disposed at any position as long as the semipermeable membrane 44 is disposed in the space constituted by the air-discharge passage 43 and the space in the reservoir tank 9. For example, the semipermeable membrane 44 may be provided in the space in the reservoir tank 9. In the case where the semipermeable membrane 44 is disposed in the space in the reservoir tank 9, the check valve 2 is disposed in the space in the reservoir tank 9 as in the embodiment illustrated in FIG. 11.

What is claimed is:

1. A liquid ejection apparatus, comprising:

a liquid ejection head comprising: a reservoir tank configured to store liquid; an inlet opening which communicates with the reservoir tank; and a plurality of ejection openings which communicate with the reservoir tank;

an air-discharge passage, extending from the reservoir tank, for discharging air in a space in the reservoir tank, to an outside;

a first sucking device configured to suck air from the reservoir tank via the air-discharge passage;

a semipermeable membrane which divides a space constituted by the space in the reservoir tank and the air-discharge passage, into a reservoir-tank-side space and a first-sucking-device-side space, the semipermeable membrane allowing communication of the air between the reservoir-tank-side space and the first-sucking-device-side space, the semipermeable membrane inhibiting communication of the liquid between the reservoir-tank-side space and the first-sucking-device-side space; and a first valve mechanism configured to divide the reservoir-tank-side space into (a) a first space located on a semipermeable-membrane side of the first valve mechanism and (b) a second space located on an inlet-opening side of the first valve mechanism, the first valve mechanism being configured to inhibit fluid from flowing from the first space to the second space, the first valve mechanism being configured to allow fluid to flow from the second space to the first space, the first space being located above the plurality of ejection openings.

2. The liquid ejection apparatus according to claim 1, further comprising a second sucking device configured to suck the liquid from the reservoir tank via the plurality of ejection openings, wherein the first valve mechanism is configured to: establish communication between the first space and the second space when an air pressure in the first space and an air pressure in the second space are in equilibrium; inhibit the fluid from flowing from the first space to the second space during operation of the second sucking device; and to allow fluid to flow from the second space to the first space at least during operation of the first sucking device.

3. The liquid ejection apparatus according to claim 1, further comprising a second valve mechanism configured to: divide the first-sucking-device-side space in the air-discharge passage, into (i) a third space located on a semipermeable-membrane side of the second valve mechanism and (ii) a fourth space located on a first-sucking-device side of the second valve mechanism; allow air to flow from the third space to the fourth space; and inhibit air from flowing from the fourth space to the third space.

4. The liquid ejection apparatus according to claim 3, wherein the second valve mechanism is configured to establish a state in which the third space and the fourth space do not communicate with each other when an air pressure of the third space and an air pressure of the fourth space are in equilibrium.

5. The liquid ejection apparatus according to claim 4, further comprising a second sucking device configured to suck the liquid from the reservoir tank via the plurality of ejection openings, wherein the second valve mechanism is configured to allow air to flow from the third space to the fourth space during operation of the first sucking device and inhibit air from flowing from the fourth space to the third space at least during operation of the second sucking device.

6. The liquid ejection apparatus according to claim 1, further comprising:

a second sucking device configured to suck the liquid from the reservoir tank via the plurality of ejection openings; and a controller, wherein the controller is configured to control the first sucking device and the second sucking device such that the controller starts actuating the second sucking device successively after an actuation of the first sucking device.

7. The liquid ejection apparatus according to claim 1, wherein the first valve mechanism is a duckbill valve formed of an elastic material noncorrosive to the liquid stored in the reservoir tank.

8. A liquid ejection apparatus, comprising:

a liquid ejection head comprising: a reservoir tank configured to store liquid; an inlet opening which communicates with the reservoir tank; and a plurality of ejection openings which communicate with the reservoir tank;

an air-discharge passage, extending from the reservoir tank, for discharging air in a space in the reservoir tank, to an outside;

a first sucking device configured to suck air from the reservoir tank via the air-discharge passage;

a semipermeable membrane which divides a space constituted by the space in the reservoir tank and the air-discharge passage, into a reservoir-tank-side space and a first-sucking-device-side space, the semipermeable membrane allowing communication of the air between the reservoir-tank-side space and the first-sucking-device-side space, the semipermeable membrane inhibiting communication of the liquid between the reservoir-tank-side space and the first-sucking-device-side space; and a check valve configured to divide the reservoir-tank-side space into (a) a first space located on a semipermeable-membrane side of the check valve and (b) a second space located on an inlet-opening side of the check valve, the check valve being configured to allow fluid to flow from the second space to the first space, the first space being located above the plurality of ejection openings.

* * * * *